US006238107B1

(12) United States Patent
Inada

(10) Patent No.: US 6,238,107 B1
(45) Date of Patent: May 29, 2001

(54) DEVELOPING APPARATUS

(75) Inventor: Hiroichi Inada, Kumamoto-ken (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/376,985

(22) Filed: Aug. 19, 1999

(30) Foreign Application Priority Data

Aug. 19, 1998 (JP) ..... 10-247749

(51) Int. Cl.[7] ..... G03D 5/00

(52) U.S. Cl. ..... 396/604; 396/611; 396/627; 118/52; 427/240

(58) Field of Search ..... 396/604, 611, 396/627; 118/52, 56, 319–321, 696, 697, 712, 716; 134/902; 427/9, 240

(56) References Cited

U.S. PATENT DOCUMENTS 4,564,280 * 1/1986 Fukuda ..... 396/611
5,374,312 12/1994 Hasebe et al. ..... 118/52
5,935,331 * 8/1999 Naka et al. ..... 118/319
5,942,035 * 8/1999 Hasebe et al. ..... 118/52
6,025,012 * 2/2000 Matsuda et al. ..... 118/52
6,086,269 * 7/2000 Bradl et al. ..... 396/611
6,165,552 * 12/2000 Anai et al. ..... 427/240

FOREIGN PATENT DOCUMENTS 3-222407 * 10/1991 (JP) ..... 396/FOR 942

* cited by examiner

*Primary Examiner*—D. Rutledge
(74) *Attorney, Agent, or Firm*—Rader, Fishman & Grauer

(57) ABSTRACT

A pure developing solution is discharged from a discharge port of a developing solution supply nozzle. A developing solution with reaction in progress flows from the center of a wafer by centrifugal force. The amount of the developing solution with reaction in progress mixing with the pure developing solution increases as it gets farther away from the wafer center, causing unequal development. To prevent such a problem, the developing solution supply nozzle is divided into a plurality of areas. The nozzle is composed so that the amount of the developing solution discharged from the discharge ports of each area gradually decreases as the areas approach the rotating center of the wafer. Thus, uniform development is achieved.

25 Claims, 16 Drawing Sheets

DEVELOPING APPARATUS

BACKGROUND OF THE INVENTION

1. Field of the Invention

The present invention relates to a developing apparatus for developing an object to be processed (hereinafter referred to as a 'target object') such as a semiconductor wafer.

2. Description of the Related Art

In a photo-resist processing step in manufacturing a semiconductor, for example, a resist film is formed by coating a resist solution on the surface of a substrate such as a semiconductor wafer (hereinafter referred to as a 'wafer'). A predetermined pattern is then exposed upon the wafer, and the wafer is developed with a developing solution. A developing apparatus has been used to perform such developing process.

Generally, a developing apparatus has a spin chuck and a nozzle for supplying a developing solution. The spin chuck rotates a wafer while holding it by vacuum. The developing solution supply nozzle moves to a predetermined position above the spin chuck. The supply nozzle is longer than the diameter of the wafer and has a header shape. Discharge ports are arranged along a line at the bottom of the supply nozzle.

In order to supply the developing solution upon the wafer using such developing solution supply nozzle, the supply nozzle must first move to a predetermined position above the wafer held by the spin chuck, a position overlapping with the diameter of the wafer. The developing solution is then supplied to the developing solution supply nozzle. The supply nozzle discharges the developing solution from the discharge ports upon the wafer, while the wafer is rotated for more than a half turn so that the developing solution is equally supplied to the entire surface of the wafer.

SUMMARY OF THE INVENTION

In such a conventional developing apparatus, nearly pure developing solution not yet starting to react is constantly supplied to the center of the wafer. However, the developing solution with reaction in progress flows outward from the wafer center by centrifugal force. Such developing solution mixes increasingly with the pure developing solution discharged from the discharge ports, as it gets farther away from the wafer center. Thus, development becomes unequal. In other words, the development progress slows down as it gets farther away from the wafer center. Therefore, the line width is finer near the wafer center, and wider near the wafer edge.

The present invention aims to solve the above-mentioned problem. Its object is to provide a developing apparatus which performs uniform development.

To solve the above-described problem, a first aspect of the present invention is a developing apparatus having a means for rotating while holding a target object, and a nozzle divided into a plurality of areas with discharge ports arranged along a line for discharging a developing solution on the surface of the target object held and rotating. The developing apparatus also has a means for controlling the discharge amount of the developing solution so that the amount of the developing solution discharged from the discharge port disposed in an area near a rotating center of the target object is less compared to the amount discharged from the ports in other areas.

The present invention has a nozzle divided into a plurality of areas and discharging less developing solution from the area near the rotating center of the target object as compared with other areas. Therefore, the ratio of a pure developing solution supplied near the rotating center of the target object and a pure developing solution supplied around the periphery of the target object is approximately the same. Thus, unequal development may be prevented.

A second aspect of the present invention is a developing apparatus having a means for rotating while holding a target object, and a nozzle divided into a plurality of areas with discharge ports arranged along a line for discharging a developing solution on the surface of the target object held and rotating. The developing apparatus also has a means for controlling an amount of the developing solution discharged from the discharge ports in each area and disposed midway of a discharge path for discharging the developing solution.

The present invention has a nozzle divided into a plurality of areas and a means for controlling the discharge amount of the developing solution discharged from the discharge ports of each area. The nozzle and the controlling means are disposed integrally. Thereby, the discharge time and amount of the developing solution discharged from each area is controlled more accurately. The number of pipes for sending the developing solution to the nozzle may also be decreased.

These and other objects and profits of the invention can be easily defined by the following explanations and the accompanied drawings.

DETAILED DESCRIPTION OF THE PREFERRED EMBODIMENT

A preferred embodiment according to the present invention will be explained with reference to the accompanied drawings.

Figure 1:
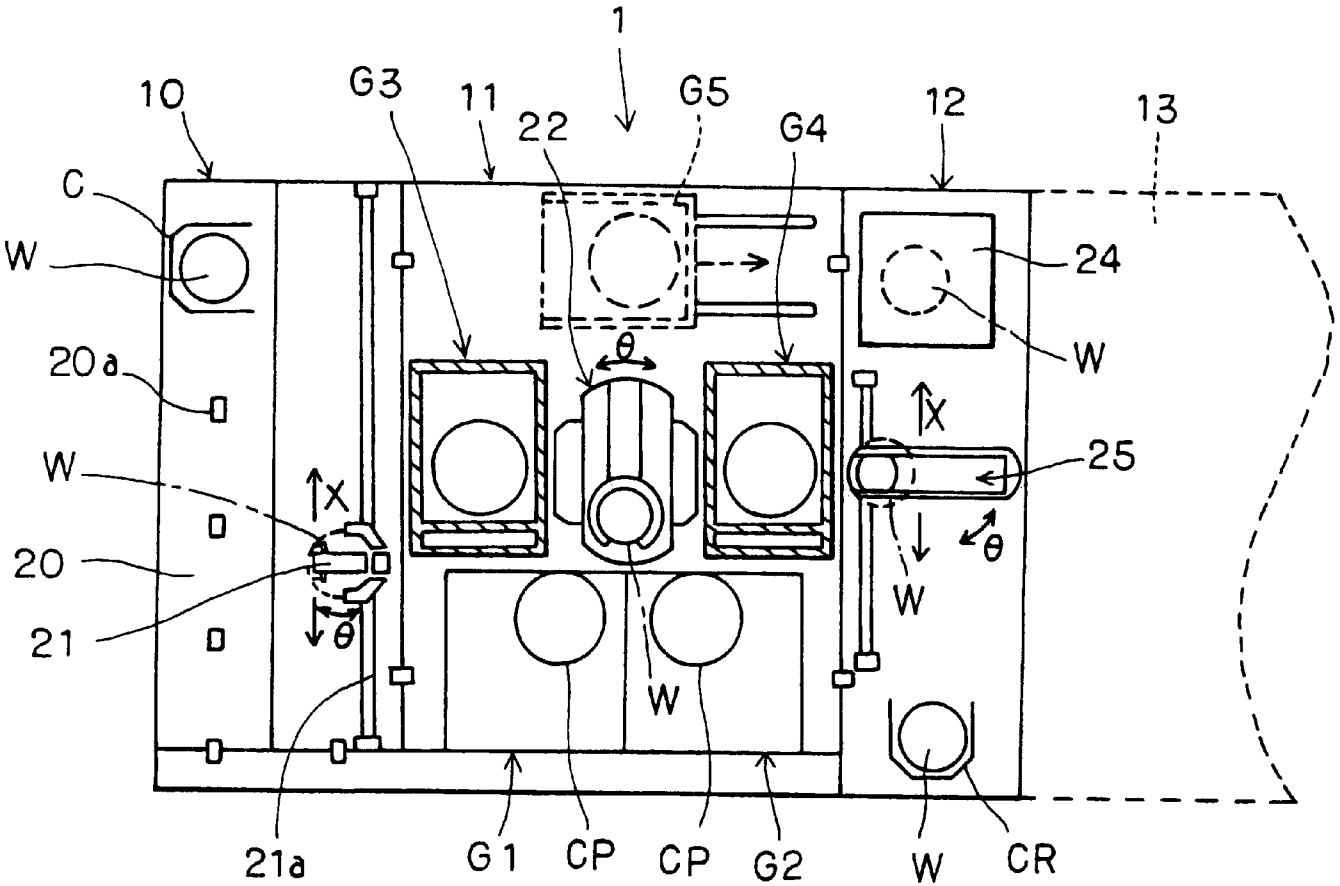
FIG. 1 is a plan view of a coating and developing apparatus concerning a preferred embodiment of the present invention.
Figure 2:
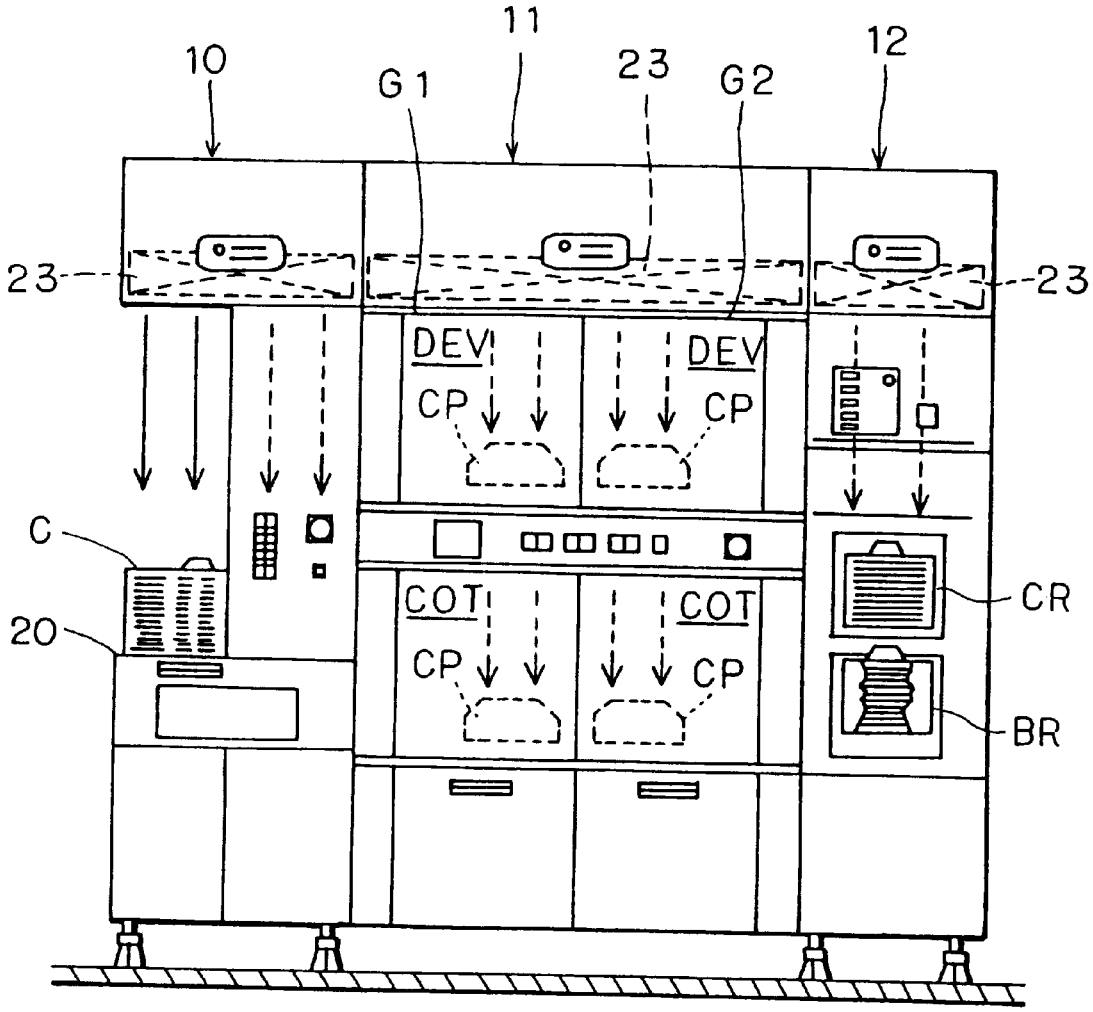
FIG. 2 is a front view of the coating and developing apparatus shown in FIG. 1.
Figure 3:
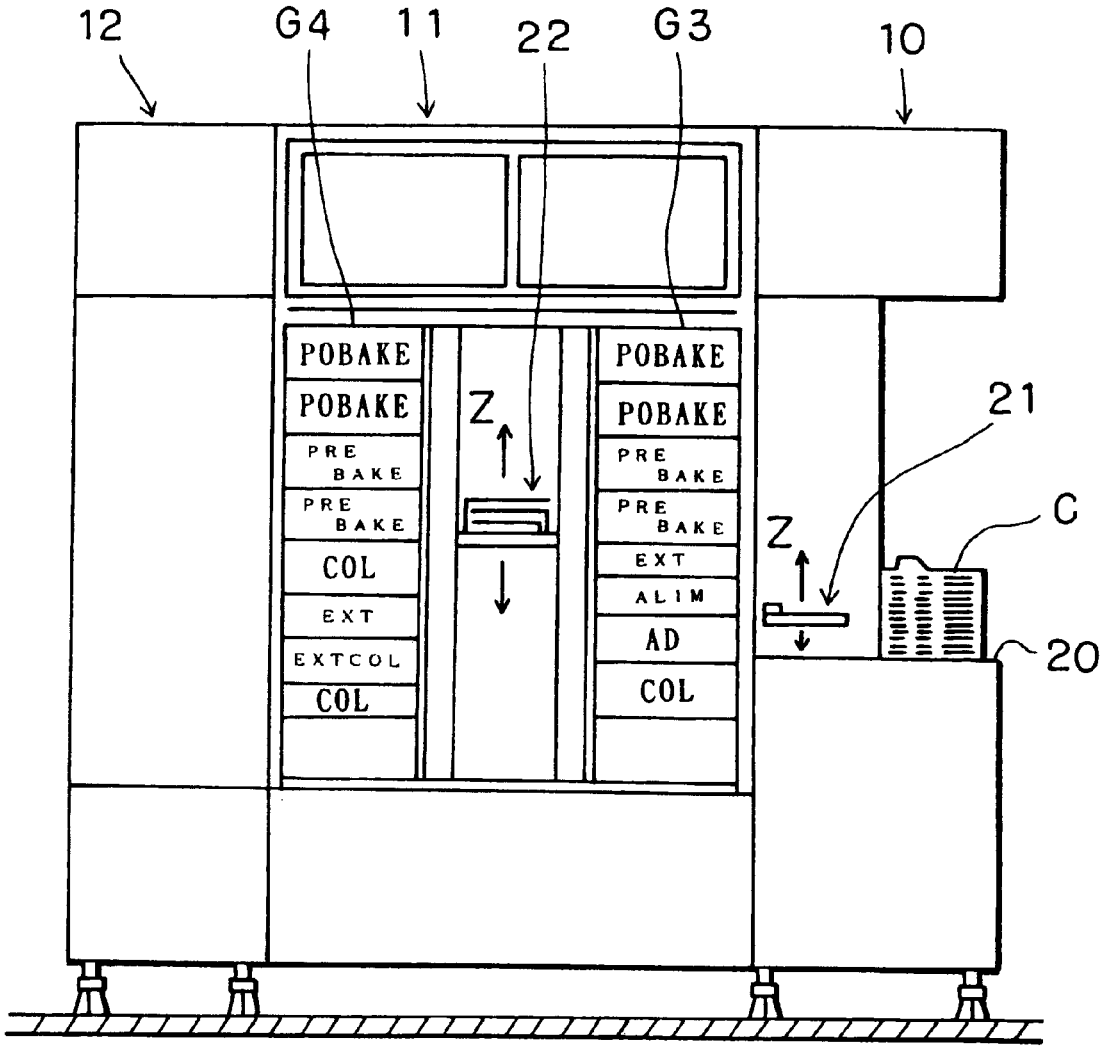
FIG. 3 is a rear view of the coating and developing apparatus shown in FIG. 1.

FIG. 1 is a plan view, FIG. 2 is a front view, FIG. 3 is a rear view of the coating and developing apparatus concerning an embodiment of the present invention.

As shown in FIGS. 1 and 3, this coating and developing unit 1 is composed of a cassette station 10, a process station 11 and an interface section 12, connected integrally. In the cassette station 10, a plurality of wafers W (25, for example) is introduced into the coating and developing unit 1 from outside in units of cassettes C, and then transferred out from the coating and developing unit 1. Wafers W are also transferred into and out of the cassettes C. In the process station 11, various kinds of single-wafer processing units are disposed multi-tiered in a predetermined position. These processing units perform a predetermined process upon the wafer W one by one during the coating and developing steps. In the interface section 12, the wafers W are delivered to and from an exposure unit 13 disposed next to the coating and developing unit 1.

In the cassette station 10, as shown in FIG. 1, a plurality of cassettes C (four, for example) is mounted on a cassette mounting table 20 in the position of a positioning projection 20*a*. The cassettes C are mounted along a line in the X-direction (the up and down direction in FIG. 1). The opening of the cassettes C, through which the wafers W are taken in and out, face the process station 11. A wafer transfer unit 21 moves in the cassettes C arrangement direction (X-direction). It also moves in the wafers W arrangement direction (Z-direction; vertical direction), the direction in which the wafers W stored inside the cassettes C are arranged. The wafer transfer unit 21 moves freely along a transfer path 21*a* and makes access selectively to each cassette C.

The wafer transfer unit 21 rotates freely in the θ direction and makes access to an alignment unit (ALIM) and an extension unit (EXT). The alignment unit and the extension unit belong to a multi-tiered units section of a third processing unit group G3 on the process station 11 side.

In the process station 11 as shown in FIG. 1, a vertical-transfer type transfer unit 22 is disposed in the center. Around it, two or more processing units are disposed multi-tiered to form processing unit groups. In such a coating and developing unit 1, five processing unit groups G1, G2, G3, G4 and G5 may be disposed. A first processing unit group G1 and a second group G2 are disposed on the front side of the system. A third processing unit group G3 is disposed next to the cassette station 10. A fourth processing unit group G4 is disposed next to the interface section 12. And a fifth processing unit group G5 shown by a broken line can be disposed on the rear side. The transfer unit 22 rotates freely in the θ direction and moves in the Z-direction in order to deliver wafers W to and from various processing units.

In the first processing unit group G1 as shown in FIG. 2, two spinner-type processing units, such as a resist coating unit (COT) and a developing unit (DEV), are two-tiered from the bottom in order. These units perform a predetermined process with the wafers W mounted on a spin chuck inside a cup CP. In the second processing unit group G2 as in the first processing unit group G1, two spinner-type processing units, such as a resist coating unit (COT) and a developing unit (DEV), are two-tiered from the bottom in order.

In the upper portion of the coating and developing unit 1 as shown in FIG. 2, high-efficiency filters 23, such as UPLA filters, are disposed in each of the above-mentioned zones (the cassette station 10, the process station 11, the interface section 12). The high-efficiency filter 23 catches and removes particles and organic materials from the air supplied from the upper-stream side of the filter 23. Thus, through the high-efficiency filter 23, a clean down-flow of air is supplied from above in the direction of the solid arrow or the dotted arrow in FIG. 2. The clean air flows to the cassette mounting table 20, the transfer path 21*a* of the wafer transfer unit 21, the first processing unit group G1, the second group G2, the third through fifth processing unit groups G3, G4 and G5 which will be mentioned later, and the interface section.

In the third processing unit group G3 as shown in FIG. 3, eight oven-type processing units are multi-tiered, performing a predetermined process with the wafers W mounted upon the mounting table. The units are, for example, a cooling unit (COL) for cooling the wafer W, an adhesion unit (AD) for performing a hydrophobic process to improve the fixity of the resist, an alignment unit (ALIM) for positioning the wafer W, an extension unit (EXT), two pre-baking units (PREBAKE) for heating before exposure and two post-baking units (POBAKE), from the bottom in order.

Similarly, in the fourth processing unit group G4 as shown in FIG. 3, eight oven-type processing units are multi-tiered, performing a predetermined process with the wafers W mounted upon the mounting table. The units are, for example, a cooling unit (COL) for cooling the wafer W, an extension/cooling unit (EXTCOL) which also cools, an extension unit (EXT), an adhesion unit (AD), two pre-baking units (PREBAKE) and two post-baking units (POBAKE), from the bottom in order.

Heat interference between the units can be kept at a minimum by disposing such units with low processing temperature as a cooling unit (COL) and an extension unit (EXTCOL) in the bottom and disposing such units with high processing temperature as a pre-baking unit (PREBAKE), a post-baking unit (POBAKE) and an adhesion unit (AD) on the top.

As shown in FIG. 1, the interface section 12 has the same size as the aforementioned process station in the depth direction (X-direction) but is smaller in the width direction. As shown in FIGS. 1 and 2, a movable pick-up cassette CR and a stable buffer cassette BR are two-tiered at the front side of the interface section 12. A peripheral exposure unit 24 is disposed at the rear side.

A wafer transfer unit 25 is disposed in the center of the interface section 12. The wafer transfer unit 25 moves in the X-direction and the Z-direction (vertical direction). It makes access to both cassettes CR and BR and to the peripheral exposure unit 24. The wafer transfer unit 25 also moves freely in the θ direction and makes access to an extension unit (EXT). The extension unit belongs to the fourth processing unit group G4 at the process station 11 side. The transfer unit 25 also makes access to the wafer delivery table (not shown) at the exposure unit side.

Figure 4:
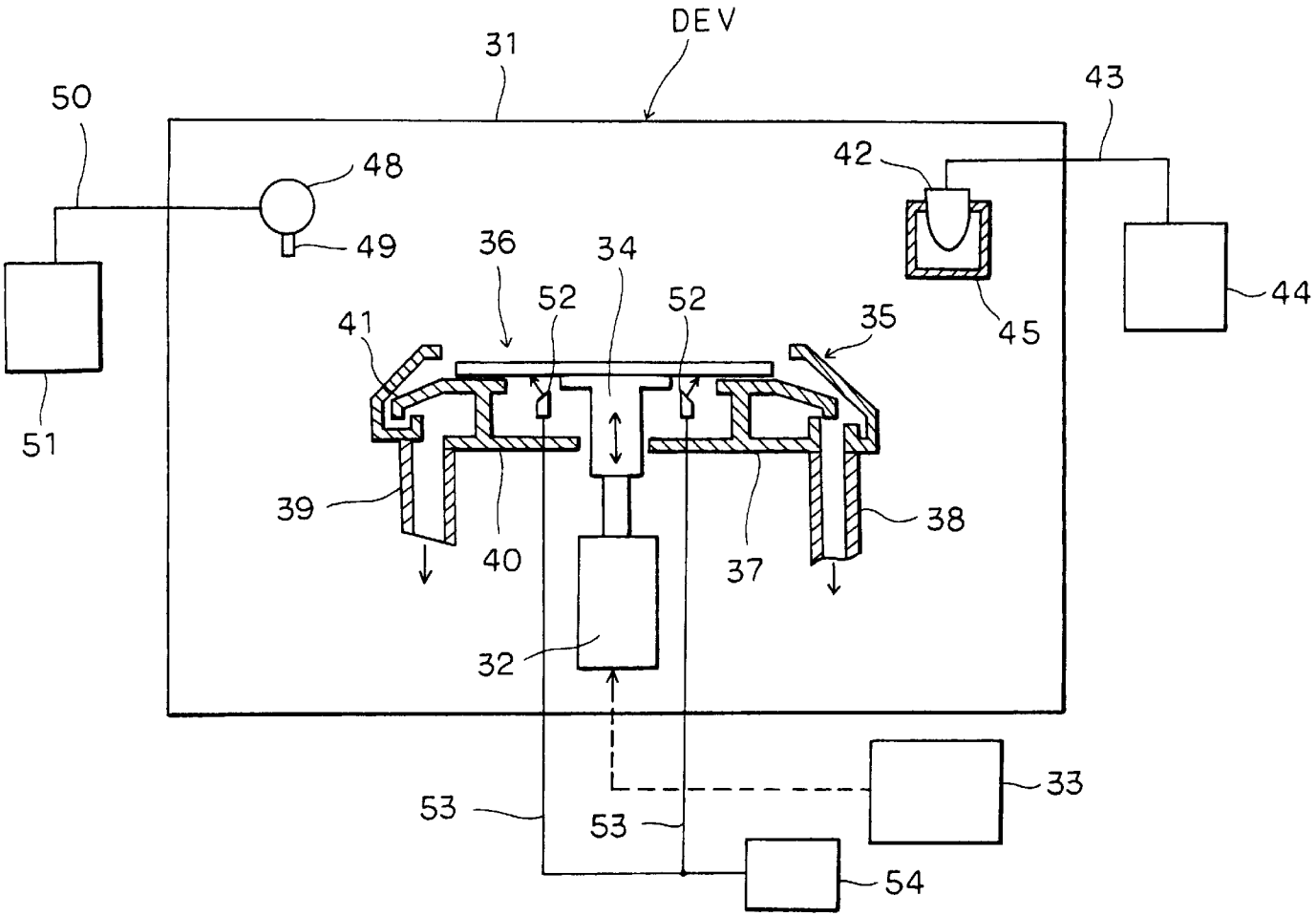
FIG. 4 is a front view showing the composition of a developing unit shown in FIG. 1.
Figure 5:
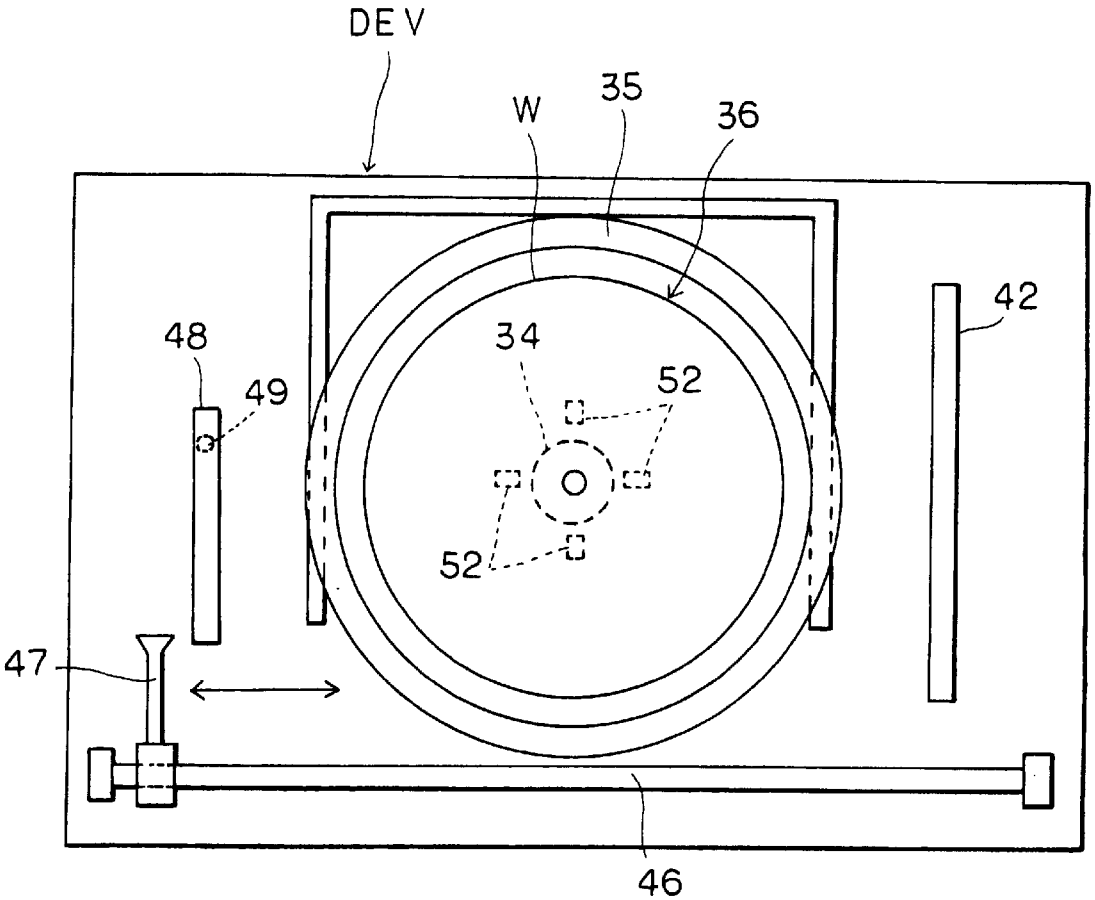
FIG. 5 is a plan view showing the composition of a developing unit shown in FIG. 4.

FIG. 4 is a front view and FIG. 5 is a plan view, both showing the composition of the above-mentioned developing unit (DEV).

As shown in FIGS. 4 and 5, a driving motor 32 is disposed at the center of a casing 31 of the developing unit (DEV). The rotation speed of the driving motor 32 may be changed freely with a controller 33 disposed separately outside the unit. A spin chuck 34 is disposed above the driving motor 32. The spin chuck 34 rotates and moves up and down freely. The wafer W to be developed is held on top of the spin chuck 34 in a horizontal position.

A cylindrical cup 35 is disposed around the spin chuck 34. The cup 35 made of resin or metal prevents the scattering of the developing solution or the washing liquid. The side wall of the cup 35 slants inward, the upper portion being narrower than the bottom portion. An opening 36 of the cup 35 has a diameter large enough to bring the wafer W downward inside the cup 35 in a horizontal position.

A bottom 37 of the 35 is slanted, and a drainpipe 38 is connected to its lowest portion. An exhaust pipe 39 for exhausting the air inside the cup 35 is connected on the opposite side of the drainpipe 38, with the driving motor 32 in between. A circular wall 40 stands up from the bottom 37 of the cup 35. A rectifying board 41 is disposed at the upper end of the circular wall 40. The rectifying board 41 is disposed close to the underside of the wafer W held by the spin chuck 34. The outer portion of the rectifying board 41 slants downward to the outside.

A developing solution supply nozzle 42 is disposed above at the side of the cup 35 inside the casing 31. The developing solution supply nozzle 42 is connected to a developing solution supply unit 44 disposed outside the developing unit (DEV) through a developing solution supply pipe 43. Ordinarily, when processing is not performed, the developing solution supply nozzle 44 is stored and waiting inside a sealed container 45. A solvent filled inside the sealed container 45 prevents the evaporation and hardening of the developing solution. The developing solution supply nozzle 42 is held by a holding arm 47. The holding arm 47 moves freely on a transfer rail 46 shown in FIG. 5, carrying the developing solution supply nozzle 42 back and forth in the direction shown by the arrow in FIG. 5.

A washing liquid header 48 is disposed at the opposite side of the developing solution supply nozzle 42, with the cup 35 in between. A washing nozzle 49 is disposed under the washing liquid header 48. The washing liquid header 48 is connected to a pure water supply unit 51 disposed outside the developing unit (DEV) through a washing liquid supply pipe 50. Pure water supplied from the pure water supply unit 51 is discharged from the washing nozzle 49. In the same way as the developing solution supply nozzle 42, the washing liquid header 48 is also held by the holding arm 47 and moves back and forth in the direction shown by the arrow in FIG. 5.

In the developing unit (DEV) as shown in FIG. 4, a washing nozzle 52 is disposed separately to supply washing liquid such as pure water to the underside of the wafer W. The washing nozzle 52 is connected to a washing liquid supply unit 54 through a supply pipe 53. So, the underside of the wafer W may also be washed with pure water. The pure water supply unit 51 may be used in common as the washing liquid supply unit 54.

Figure 6:
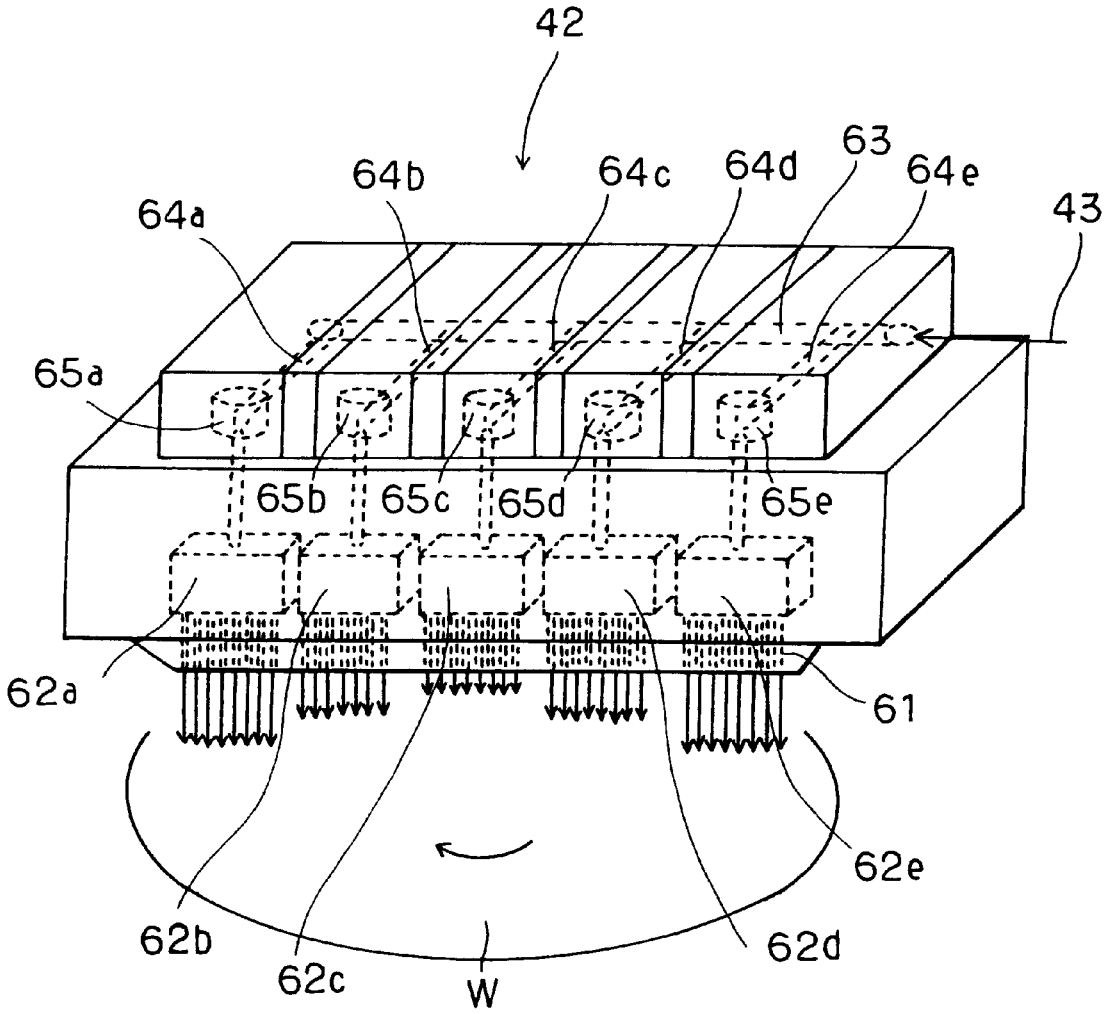
FIG. 6 is a perspective view showing the composition of a developing solution supply nozzle shown in FIG. 4.
Figure 7:
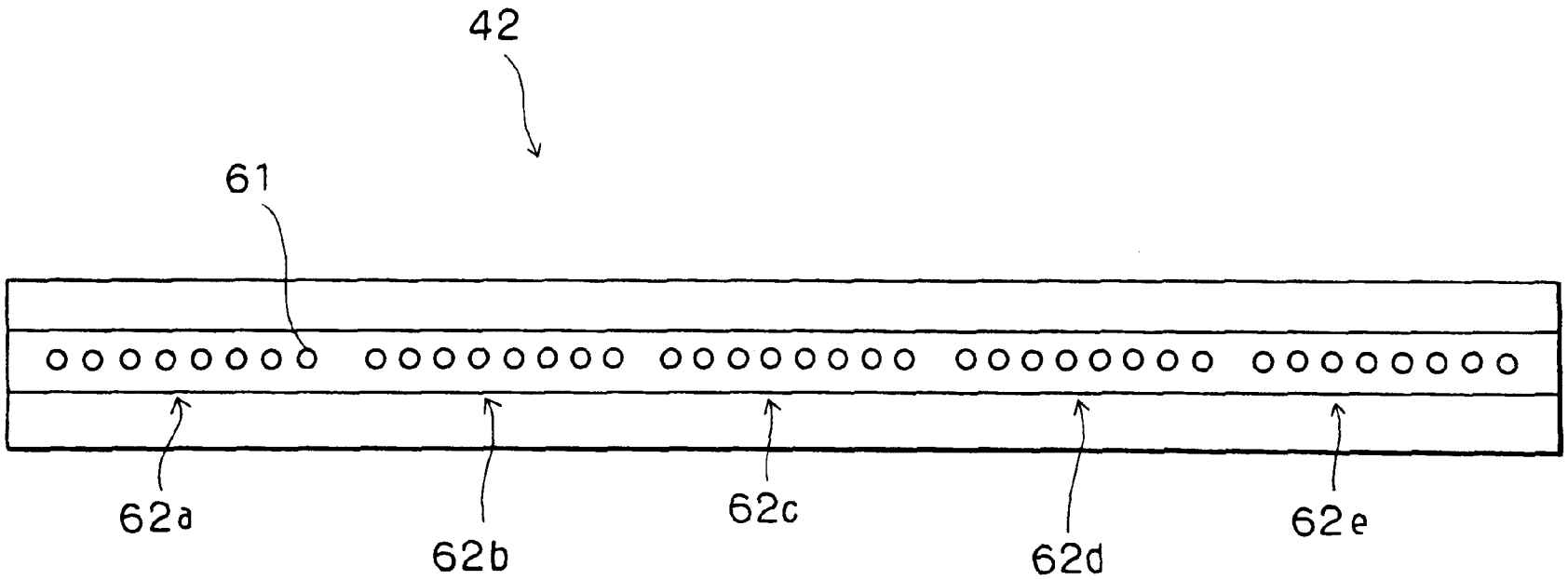
FIG. 7 is a bottom view showing the composition of a developing solution supply nozzle shown in FIG. 6.

FIG. 6 is a perspective view and FIG. 7 is a bottom view, both showing the composition of the above-mentioned developing solution supply nozzle 42.

As shown in FIGS. 6 and 7, the developing solution supply nozzle 42 has approximately the same diameter as the wafer W. A plurality of discharge ports 61 is disposed along a line under the developing solution supply nozzle 42, to discharge the developing solution upon the surface of the wafer W. The developing solution supply nozzle 42 is divided into a plurality of areas, for example, into five areas 62*a*~62*e*. These areas 62*a*~62*e* are symmetrical about the area 62*c* at the rotating center of the wafer W. In other words, the areas 62*b* and 62*d* are disposed symmetrical about the area 62*c* as the center, and the areas 62*a* and 62*e* are disposed symmetrical about the area 62*c* as the center.

A pipe 63 is disposed inside the developing solution supply nozzle 42, in the direction of the diameter of the wafer W. The pipe 63 is connected to the pipe 43 whose other end is shown in FIG. 4. The developing solution is supplied from the developing solution supply unit 44 through the pipe 43. Pipes 64*a*~64*e* branch from the pipe 63 into the areas 62*a*~62*e*. The branched pipes 64*a*~64*e* are connected to the discharge ports 61 of the areas 62*a*~62*e*, respectively.

Air-operation valves 65*a*~65*e* are inserted in the branched pipes 64*a*~64*e*, respectively. The air-operation valves 65*a*~65*e* are disposed integrally with the developing solution nozzle 42, as a means for controlling the amount of the developing solution discharged from the discharge ports 61 of the areas 62*a*~62*e*. The controller 33 shown in FIG. 4 controls the timing for opening/closing and the release amount of the air-operation valves 65*a*~65*e*. By composing the unit in the manner mentioned above, the present embodiment decreases the number of pipes and makes it possible to control the discharge timing from each area separately in units of 0.1 second.

The developing unit (DEV) according to an embodiment of the present invention is composed as mentioned above. After exposure, the wafer W is mounted on the spin chuck 34 inside the cup 35. The developing solution supply nozzle 42 held by the holding arm 47 moves to a predetermined position above the wafer W, a position overlapping with the diameter of the wafer W. The developing solution supply nozzle 42 comes down, and the developing solution is supplied to the developing solution supply nozzle 42 from the developing solution supply unit 44 while the wafer W rotates slowly.

Figure 8:
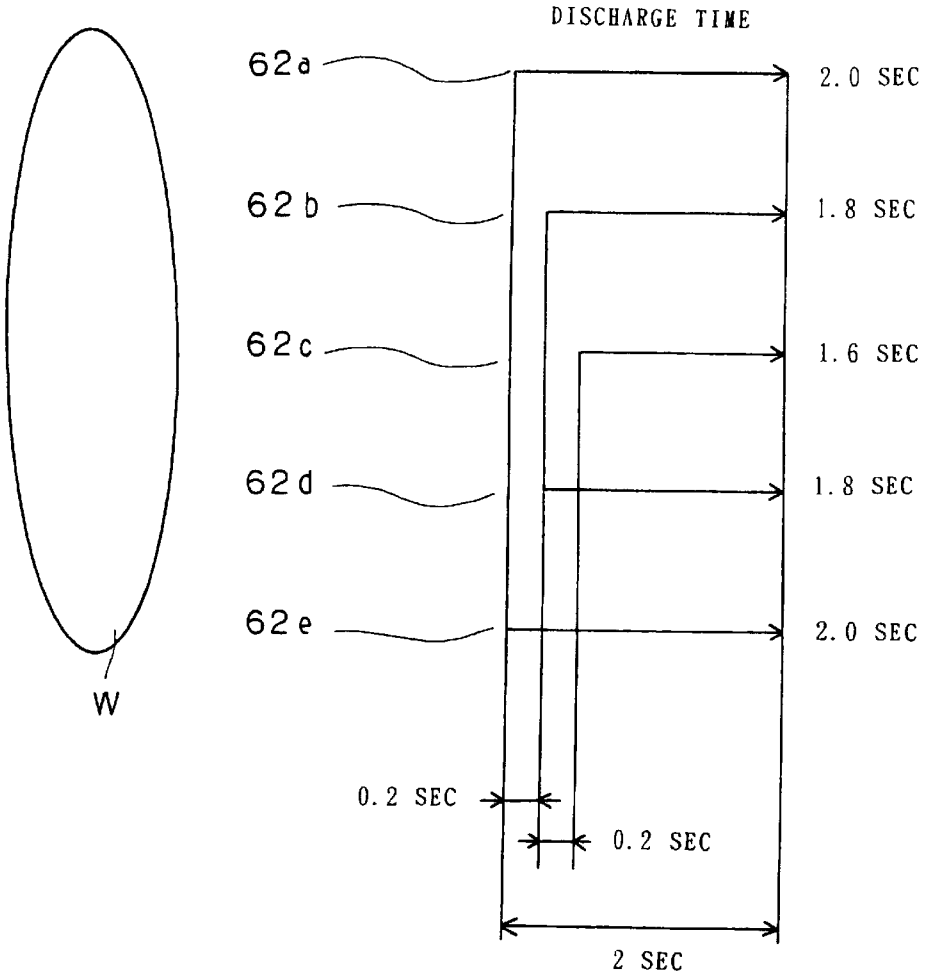
FIG. 8 is a drawing showing an example of the timing for discharging a developing solution from the discharge ports in each area of the developing solution supply nozzle shown in FIG. 6.
Figure 9:
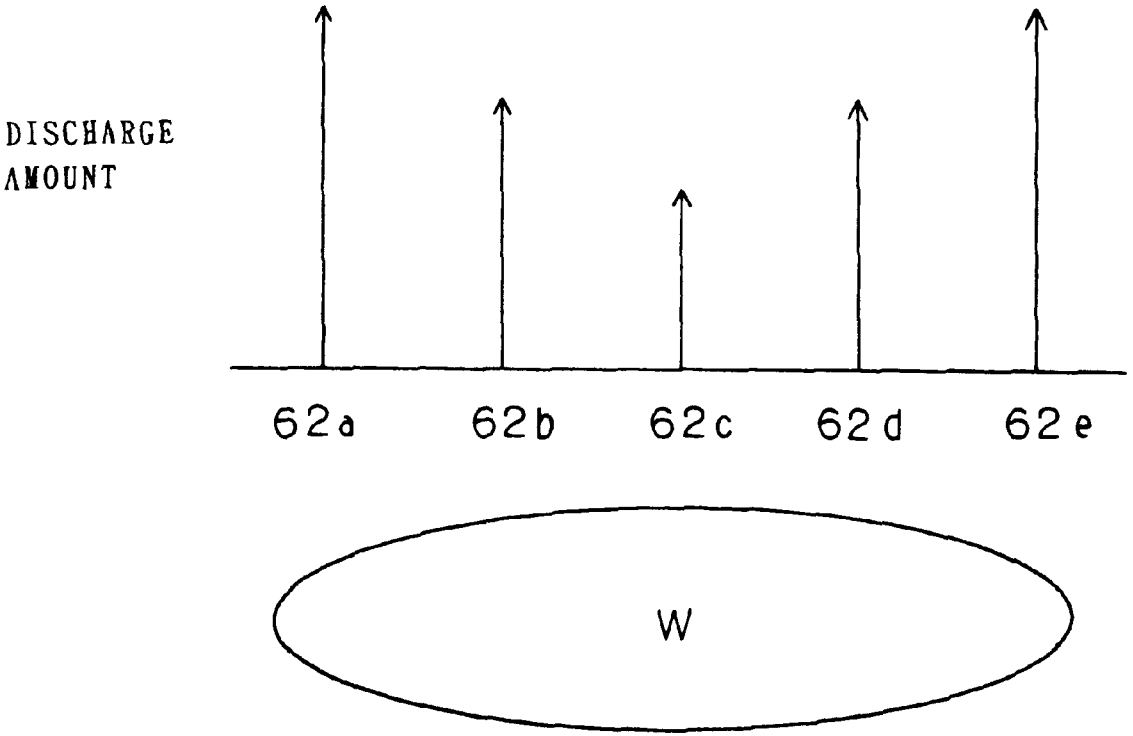
FIG. 9 is a drawing showing an example of the amount of developing solution discharged from the discharge ports in each area of the developing solution supply nozzle shown in FIG. 6.

FIG. 8 is a drawing showing an example of the timing for discharging a developing solution from the discharge ports 61 in areas 62*a*~62*e*, when the developing solution is supplied as mentioned above. FIG. 9 is a drawing showing an example of such discharge amount. Such discharge timing and amount are controlled by the air-operation valves 65*a*~65*e* as mentioned above, by controlling the timing for opening/closing and the narrowing of the flow amount.

FIG. 8 shows the discharge timing. The developing solution is first discharged from the discharge ports 61 of the areas 62*a* and 62*e* at the periphery of the wafer W. 0.2 seconds after that, the developing solution is discharged from the discharge ports 61 of the areas 62*b* and 62*d* in the middle of the wafer W. And 0.2 seconds after that, the developing solution is discharged from the discharge ports 61 of the area 62*c* at the center of the wafer W. The developing solution is discharged for two seconds from the discharge ports 61 of the areas 62*a* and 62*e*, for 1.8 seconds from the discharge ports 61 of the areas 62*b* and 62*d*, and for 1.6 seconds from the discharge ports 61 of the area 62*c*. Needless to say, these timing show only an example.

FIG. 9 shows the discharge amount. A largest amount of the developing solution is discharged from the discharge ports 61 of the areas 62*a* and 62*e* at the periphery of the wafer W. Second largest amount of the developing solution is discharged from the discharge ports 61 of the areas 62*b* and 62*d* in the middle of the wafer W. And the least amount of the developing solution is discharged from the discharge ports 61 of the area 62*c* at the center of the wafer W.

In other words, in this embodiment, the discharge ports 61 of the area 62*c* at the rotating center of the wafer W discharge the least amount of developing solution among the areas 62*a*~62*e*. Therefore, the ratio of the pure developing solution supplied to the rotating center of the wafer W and the pure developing solution supplied to the middle or the periphery of the wafer W are the same. Thus, unequal development is prevented and the line width upon the wafer W becomes uniform.

Another embodiment of the invention will be explained next.

Figure 10:
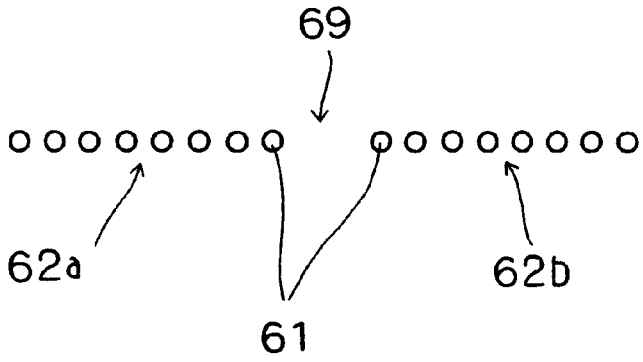
FIG. 10 is a drawing to explain the problem arising when the developing solution supply nozzle is divided into a plurality of areas as the case of the present invention.

In the above-mentioned embodiment, as shown in FIG. 10, sometimes a "gap" 69 arises between the discharge ports 61 at the border of the adjoining areas (62*a* and 62*b*, for example) when dividing the developing solution supply nozzle 42 into a plurality of areas 62*a*~62*e*. Such a "gap" 69 might cause unequal development. The following embodiment shown in FIGS. 11 and 12 aims to prevent this problem.

Figure 11:
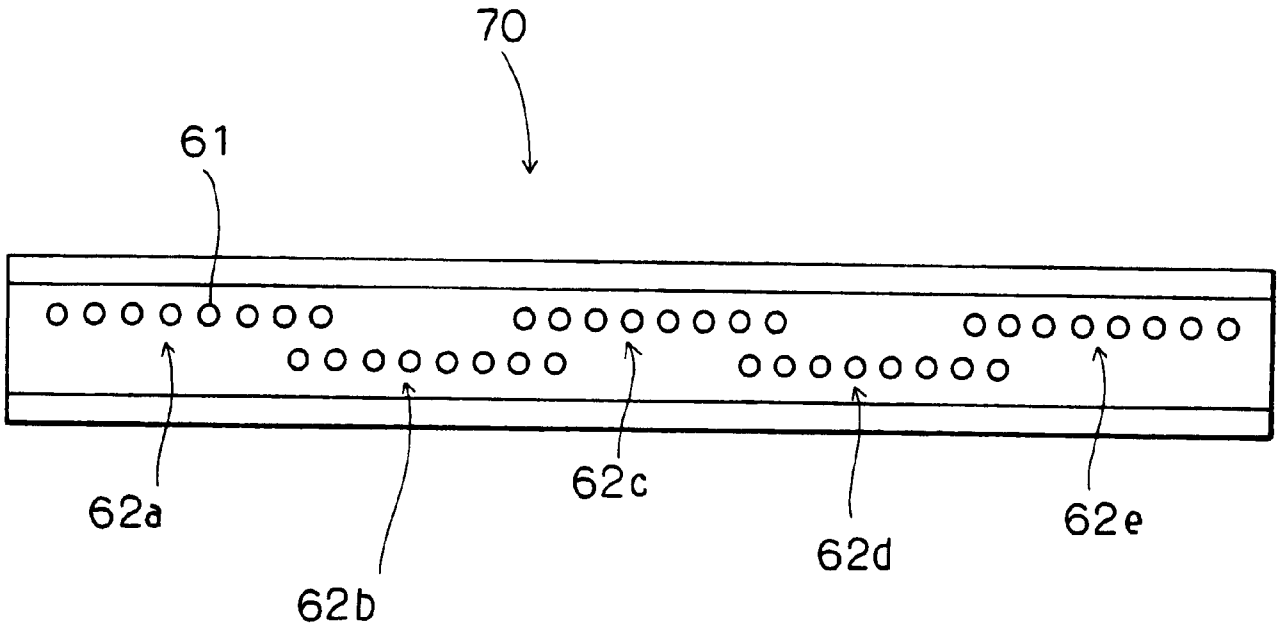
FIG. 11 is a bottom view showing the composition of a developing solution supply nozzle concerning another embodiment.

FIG. 11 is a bottom view showing the composition of the developing solution supply nozzle concerning another embodiment of the invention.

As shown in FIG. 11, a developing solution supply nozzle 70 has a plurality of areas 62*a*~62*e* arranged alternately to prevent the above-mentioned "gap". In such a composition, there will be a portion where the discharge ports 61 overlap between the adjoining areas. The size of the discharge ports in this overlapping portion should be made smaller than the other portion, for example, half. Or the density of the discharge ports 61 in such a portion could be made more sparse, for example, half. Thus, development uniformity improves.

Figure 12:
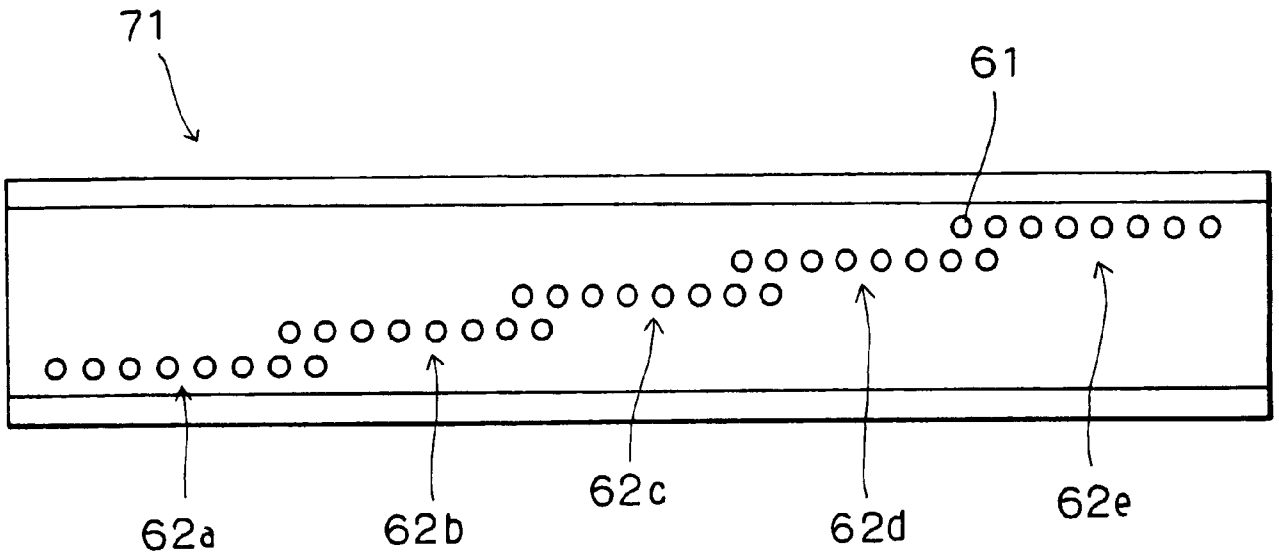
FIG. 12 is a bottom view showing the composition of a developing solution supply nozzle concerning another embodiment.

FIG. 12 is bottom view showing the composition of the developing solution supply nozzle concerning another embodiment.

As shown in FIG. 12, a developing solution supply nozzle 71 has a plurality of areas 62*a*~62*e* arranged like a stairway, with an overlapping portion of the discharge ports 61 between the adjoining areas. Thus, the above-mentioned "gap" is prevented. The composition may be the same as mentioned above concerning the overlapping portion of the discharge ports 61 between the adjoining areas.

Figure 13:
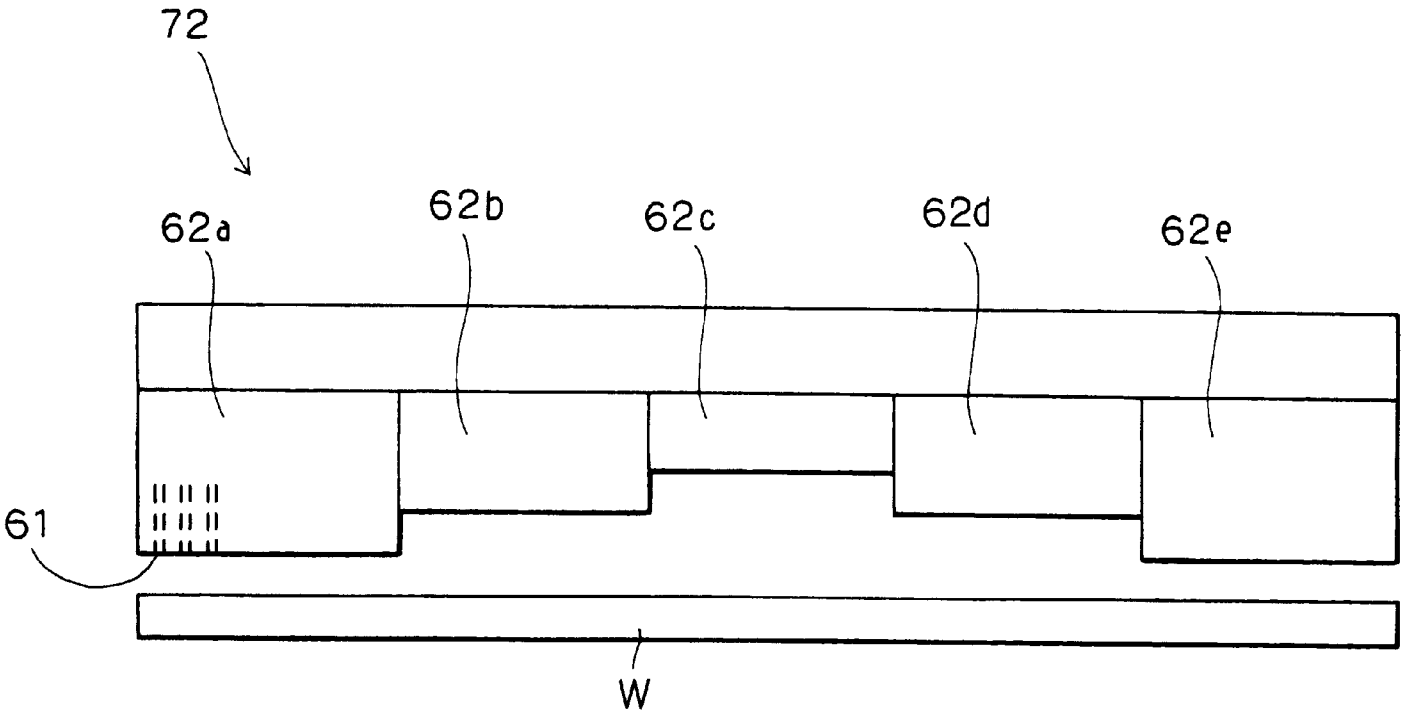
FIG. 13 is a front view showing the composition of a developing solution supply nozzle concerning still another embodiment.

FIG. 13 is a front view showing the composition of the developing solution supply nozzle concerning still another embodiment of the invention.

As shown in FIG. 13, a developing solution supply nozzle 72 is composed so that the areas 62*a*~62*e* will have different heights. The discharge ports 61 of the areas 62*a* and 62*e* at the periphery of the wafer W may be disposed in the lowest position. The discharge ports 61 of the areas 62*b* and 62*d* in the middle of the wafer W are in the second lowest position. And the discharge ports 61 of the area 62*c* at the center of the wafer W are disposed at the highest position. By changing the height in such a way, the timing when the developing solution discharged from each area reaches the wafer W will be controlled. Thus, equal development is made possible.

Figure 14:
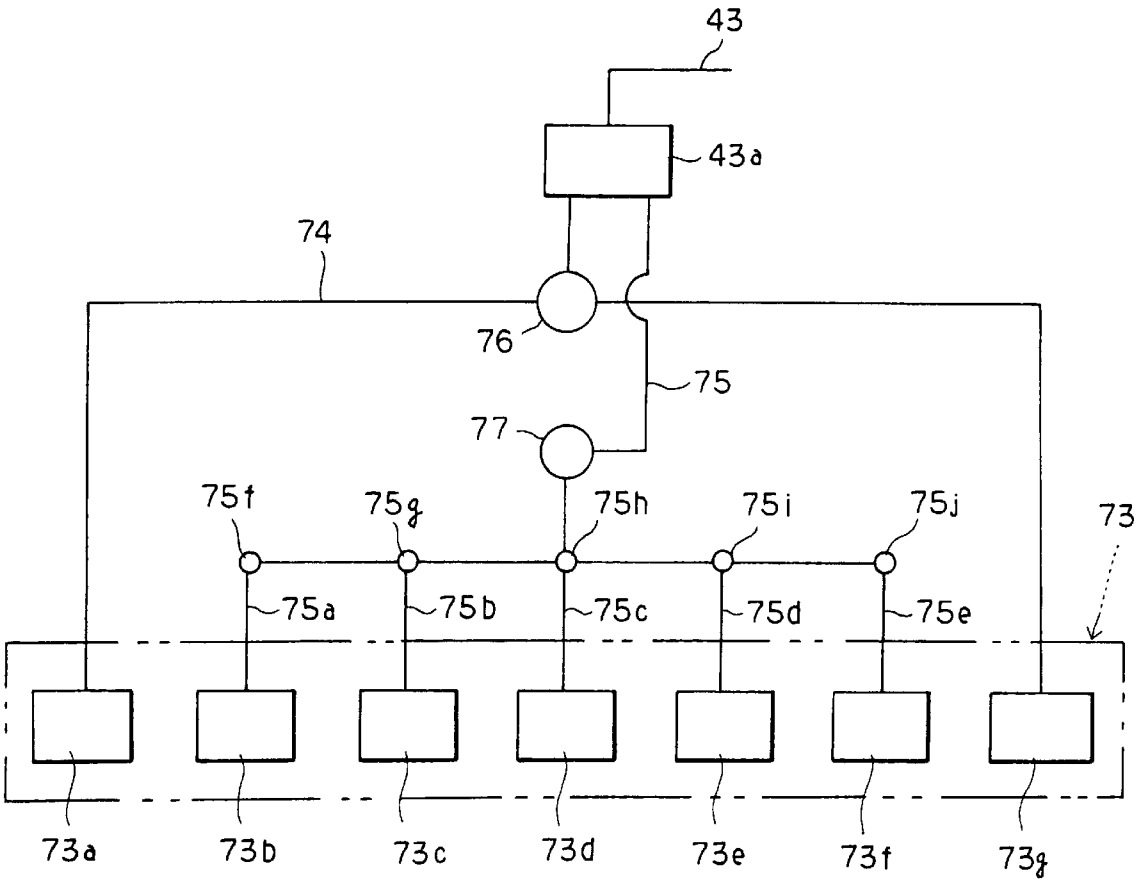
FIG. 14 is a schematic view showing the composition of a developing solution supply nozzle concerning still another embodiment.

FIG. 14 is a schematic view showing the composition of the developing solution supply nozzle concerning still another embodiment.

Similar to the above-mentioned embodiment, a developing solution supply nozzle 73 has a length approximately the same as the diameter of the wafer W. Beneath it, a plurality of discharge ports is disposed along a line for discharging a developing solution on the surface of the wafer W. In this embodiment, these discharge ports are divided into seven areas 73*a*~73*g*. These areas are symmetrical about the area 73*d* at the rotating center of the wafer W.

Two pipes 74 and 75 are connected to the areas 73*a*~73*g* of the developing solution supply nozzle 73. Electromagnetic valves 76 and 77 are inserted in these pipes 74 and 75. And through a junction 43*a*, the pipes 74 and 75 are connected to the developing solution supply pipe 43 connected to the developing solution supply unit 44 shown in FIG. 4.

The pipe 74 is connected to the areas 73*a* and 73*g* at the periphery of the wafer W. The pipe 75 is connected to all the other areas 73*b*~73*f* except the areas 73*a* and 73*g* at the wafer edge, including the area 73*d* at the center of the wafer W. To be more specific, the pipe 75 has branched pipes 75*a*~75*e*. These branched pipes 75*a*~75*e* are connected to the areas 73*b*~73*f*, excluding the areas 73*a* and 73*g* at the wafer edge. Needle valves 75*f*~75*j* are inserted in the branched pipes 75*a*~75*e*, respectively. And by adjusting the release amount of these needle valves 75*f*~75*j*, the amount of the developing solution supplied from the areas 73*b*~73*f* can be adjusted minutely.

This embodiment is composed to supply the developing solution in two routes, from the areas 73*a* and 73*g* at the periphery of the wafer W and from the other areas 73*b*~73*f*. By opening and closing of the above-mentioned electromagnetic valves 76 and 77, the discharge amount of the developing solution supplied from the areas 73*a* and 73*g* at the wafer edge and the discharge amount of the developing solution supplied from the other areas 73*b*~73*f* are controlled separately. Therefore, by adequately adjusting the movement of the electromagnetic valves 76 and 77 as a means for controlling the discharge amount, the ratio of the pure developing solution supplied near the rotating center of the target object, wafer W, and the ratio of the pure developing solution supplied to the periphery of the target object can be controlled to be approximately the same. Thus, unequal development may be decreased.

Especially by separating the supply route of the developing solution to the areas 73*a* and 73*g* at the periphery of the wafer W where the line width tend to become wide, independent control is made easier and the development will be better balanced.

Figure 15:
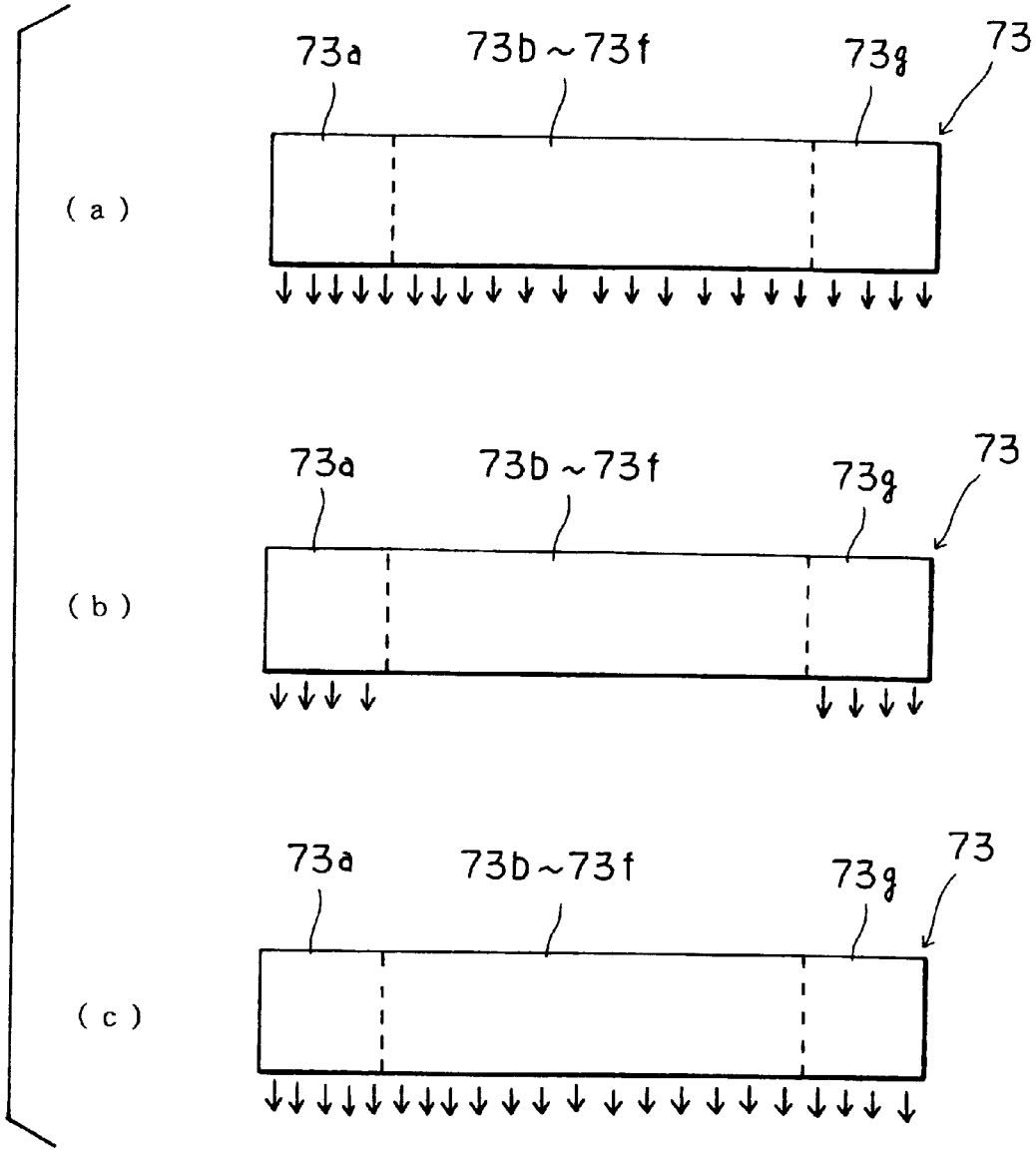
FIG. 15 is a schematic view showing an example of the actual timing for supplying the developing solution using a developing solution supply nozzle shown in FIG. 14.

FIG. 15 is a schematic view showing an example of the actual timing for supplying the developing solution, using the developing solution supply nozzle 73 shown in FIG. 14. First, as shown in FIG. 15(*a*), all of the electromagnetic valves 76, 77, and the needle valves 75*f*~75*j* are kept open. The developing solution from the discharge ports in all the areas 73*a*~73*g* are supplied for a predetermined time period. Next, as shown in FIG. 15(*b*), the electromagnetic valve 77 is closed. The discharging from the areas 73*b*~73*f* is stopped, the developing solution being supplied only from the areas 73*a* and 73*g* at the wafer edge for a predetermined time period. And as shown in FIG. 15(*c*), the electromagnetic valve 77 is opened once more and the developing solution is supplied from the discharge ports in all the areas 73*a*~73*g*. The discharge time of pure developing solution from the areas 73*a* and 73*g* at the wafer edge becomes longer than the discharge time from the other areas 73*b*~73*f*. Thus, the ratio of pure developing solution supplied to the middle of the wafer W and to the periphery of the wafer W becomes equal.

Needless to say, the supply timing of the developing solution shown in FIG. 15 is only one example. The developing solution may be supplied from the discharge ports of all the areas 73*a*~73*g* for a predetermined time period and then, the developing solution may be supplied only from the areas 73*a* and 73*g* at the periphery of the wafer W for a little longer.

As mentioned in the above embodiment, it is favorable to control the discharge amount to be the least from the discharge ports of the area 73*d* at the rotating center of the wafer W, the discharge amount increasing as the area approaches the wafer edge. The release amount of the needle valves 75*f*~75*j* may be adjusted for controlling as such.

However, there still remains a discharge amount difference of the developing solution within the area 73*d* at the rotating center of the wafer W, between the center of the area 73*d* where the developing solution is constantly supplied to the same place and near the periphery of the area 73*d*. Since the center of the area 73*d* is also the rotating center of the entire developing solution supply nozzle 73, when a predetermined supply pressure is applied to the area 73*d* by adjusting the needle valve 75*h* and if the hole diameter of the discharge ports are all the same, the discharge amount will be large near the center of the area 73*d* and smaller near the edge. Therefore, the size of the discharge ports should not be the same in the area 73*d* at the rotating center of the wafer W. It is desirable to form the size of the discharge ports smaller near the rotating center so that less developing solution is discharged from the rotating center in the area 73*d*.

Figure 16:
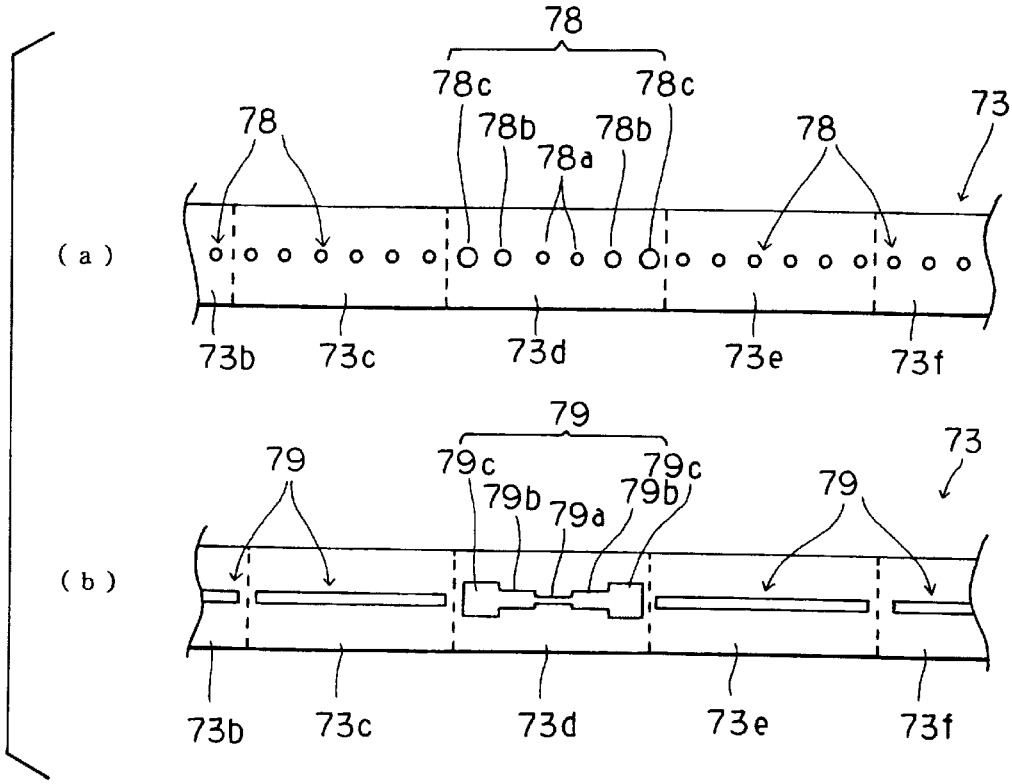
FIG. 16 is a bottom view of a developing solution supply nozzle showing the composition when changing the size of the discharge ports.

FIG. 16 is a bottom view of the developing solution supply nozzle 73, showing the composition when changing the size of the discharge ports. FIG. 16(*a*) shows discharge ports 78 in circular shape. As shown in the drawing, the diameter of a discharge port 78*a* near the center of the area 73*d* is the smallest. Discharge ports 78*b* and 78*c* disposed at the edge have a larger hole diameter. FIG. 16(*b*) shows discharge ports 79 shaped like a slit in the length direction of the discharge solution supply nozzle 73. In the area 73*d* at the rotating center of the wafer W, the slit width of a discharge port 79*a* at the center is the narrowest. The slit width of the discharge ports 79*b* and 79*c* at the edge are wider. By forming the discharge ports in this way, even when the developing solution is supplied with a predetermined pressure in the area 73*d*, less developing solution is discharged from the discharge ports 78*a* and 79*a* at the center, and more developing solution is discharged from the discharge ports 78*b*, 78*c*, 79*b* and 79*c* at the edge. Thus, the ratio of pure developing solution supplied within the area 73*d* will become even, preventing unequal line width in the area 73*d*.

In this embodiment, the supply route of the developing solution to the areas 73*a* and 73*g* at the periphery of the wafer W is independent. Therefore, the developing solution supplied through the pipe 74 may be more dense than the developing solution supplied through the pipe 75. Thus, the developing speed near the edge may become faster, preventing unequal development.

Moreover, by disposing a heating member (not shown) in the pipe 74, the temperature of the developing solution discharged from the areas 73*a* and 73*g* at the edge of the wafer W may be controlled to be higher than the temperature of the developing solution discharged from the other areas 73*b*~73*f*. Thus, the developing speed near the edge may become faster, preventing unequal development.

Needless to say, the present invention is not to be restricted to the above-described embodiments.

For example, the present invention may be applied not only to a developing unit for developing the wafer W but also to a developing unit for developing other substrates such as an LCD substrate.

As mentioned above, the present invention is a developing apparatus having a nozzle with discharge ports arranged along a line for discharging a developing solution on the surface of a rotating target object. The nozzle is divided into a plurality of areas. Less developing solution is discharged from the discharge ports of an area at a rotating center of the target object as compared to other areas. The ratio of a pure developing solution supplied to the rotating center of the target object and the ratio of a pure developing solution supplied to the periphery of the target object is approximately the same. Thus, the development uniformity improves.

According to the invention, the areas are arranged to be approximately symmetrical about the rotating center of the target object. Therefore, the developing solution is supplied to the entire surface of the target object by rotating it for at least half a turn. The developing solution may also be supplied evenly in the rotating direction.

According to the invention, the amount of the developing solution discharged from each area decreases as the area approaches the rotating center of the target object. Therefore, the ratio of the pure developing solution supplied to the rotating center of the target object and the ratio of the pure developing solution supplied to the periphery of the target object become more accurately equal. Thus, the development uniformity further improves.

According to the invention, the "gap" of the discharge ports arising between the adjoining areas is prevented by composing the adjoining areas to partly overlap in the rotating direction of the target substrate. Thus, development becomes more uniform.

According to the invention, the timing when the developing solution reaches the surface of the target object corresponding to each area and the liquid pressure upon impact may be controlled by changing the height of the areas. Thus, uniform development is achieved.

The present invention is a developing apparatus having a nozzle with discharge ports arranged along a line for discharging a developing solution on the surface of a rotating target object. The nozzle is divided into a plurality of areas, and has a means disposed integrally for controlling an amount of the developing solution discharged from the discharge ports in each area. Therefore, the discharge time and amount of the developing solution discharged from each area may be controlled more accurately. The number of pipes for sending the developing solution to the nozzle may also be decreased.

According to the invention, the discharge time of the developing solution being discharged from each area is shorter as the areas approach the rotating center of the target object. Therefore, the ratio of the pure developing solution supplied to the rotating center of the target object and the ratio of the pure developing solution supplied to the periphery of the target object are approximately the same. Thus, unequal development may be decreased.

According to the invention, the means for controlling the discharge amount of the developing solution is an air-operating valve or an electromagnetic valve. Therefore, the on/off switching of the discharging of the developing solution is performed precisely. The discharge time and amount of the developing solution discharged from each area may also be controlled more accurately.

The invention has a means for controlling the amount of the developing solution discharged from the discharge ports of each area, disposed separately in the areas at the periphery of the target object and in other areas. Therefore, the ratio of the pure developing solution supplied to the rotating center of the target object and the ratio of the pure developing solution supplied to the periphery of the target object are approximately the same. Thus, unequal development is decreased.

According to the invention, the discharge time of the developing solution being discharged from the areas at the periphery of the target object is longer than the discharge time of the developing solution being discharged from the other areas. Therefore, the ratio of the pure developing solution supplied to the rotating center of the target object and the ratio of the pure developing solution supplied to the periphery of the target object are approximately the same. Thus, unequal development is decreased.

According to the invention, the density of the developing solution discharged from the areas at the periphery of the target object is higher than the density of the developing solution discharged from the other areas. Therefore, the developing speed is accelerated at the periphery of the target object and the development uniformity improves.

According to the invention, the temperature of the developing solution discharged from the areas at the periphery of the target object is higher than the temperature of the developing solution discharged from other areas. Therefore, the developing speed is accelerated at the periphery of the target object and unequal development decreases.

According to the invention, the discharge ports in the area at the rotating center of the target object are formed in a size becoming smaller as they approach the rotating center and discharging less developing solution. Therefore, the ratio of the pure developing solution near the center and at the periphery may be more even within the area at the rotating center. Thus, unequal development is decreased within the area at the rotating center.

The above-described embodiments are strictly intended to bring the technical contents of the present invention into focus. Therefore, the present invention should not be interpreted in a narrow sense by limiting to such a concrete example, but it is applicable in various forms within the range of the spirit of the present invention and the extent described in the claims.

What is claimed is:

1. An apparatus for developing an object to be processed, said object having a circular disk shape, said apparatus comprising:

a spin chuck that holds and rotates the object;

a nozzle having a plurality of discharge ports arranged along a longitudinal direction of the nozzle, the nozzle being capable of being positioned at a discharge position located above the object held by the spin chuck, the plurality of discharge ports being divided into a plurality of discharge port groups each including at least one of the discharge ports, the nozzle being divided into a plurality of areas with respect to the longitudinal direction, each of the areas provided with one of the discharge port groups respectively, the areas including a central area facing a central portion of the object and a pair of outermost areas facing peripheral portions of the object diametrically opposed each other respectively; and a controller that controls a discharge amount of a developing solution wherein an amount of the developing solution discharged from the central area discharge port group is less than that from each of the other discharge port groups.

2. The apparatus according to claim 1, wherein the discharge ports are positioned symmetrically about a rotating center of the object held by the spin chuck.

3. The apparatus according to claim 1, wherein the discharge amount from of each discharge port groups varies relative to its proximity to the central area of the nozzle, the discharge amount from the discharge port group of the central area being minimum.

4. The apparatus according to claim 1, wherein the nozzle is positioned at the discharge position, each of the discharge port groups is positioned remote from the object at a predetermined distance and the distance between one of the discharge port groups and the object is different from that of an adjacent discharge port group from the object.

5. The apparatus according to claim 4, wherein the distance between each discharge port group and the object varies relative to its proximity to the central area of the nozzle, the distance between the discharge port group of the central area being greatest.

6. The apparatus according to claim 1, further comprising a discharge passage connected to each of the discharge port groups, the passages supply the developing solution from a developing solution supply source to each of the discharge port groups, and the controller comprising a plurality of valves connected to the passages to control the discharge amount from each of the discharge port groups.

7. The apparatus according to claim 1, wherein at least one of the discharge ports of the discharge port groups overlaps each other as viewed in a transverse direction of the nozzle.

8. An apparatus for developing an object having a circular disk shape, said apparatus comprising:

a spin chuck that holds and rotates the object;

a nozzle having a plurality of discharge ports arranged along a longitudinal direction of the nozzle, the nozzle being capable of being positioned at a discharge position located above the object held by the spin chuck, the plurality of discharge ports being divided into a plurality of discharge port groups each including at least one of the discharge ports, the nozzle being divided into a plurality of areas with respect to the longitudinal direction, each of the areas provided with one of the discharge port groups respectively, the areas including a central area facing a central portion of the object and a pair of outermost areas facing peripheral portions of the object diametrically opposed each other respectively when the nozzle is located at the discharge position;

a plurality of discharge passages each connected to each of the discharge port groups respectively to supply a developing solution to the discharge port groups; and a plurality of valves provided at the discharge passages that control the amount of the developing solution supplied to each discharge port groups through the passages.

9. The apparatus according to claim 8, the devices further comprising:

a first valve that controls a first discharge amount of the developing solution from the discharge port groups in the outermost areas;

a second valve that controls a second discharge amount of the developing solution from the discharge port groups in the areas other than the outermost areas.

10. The apparatus according to claim 8, wherein the valves control the respective amount of the developing solution supplied to the discharge port groups through the passages so that a first discharge amount from each of the discharge port groups of the outermost areas is greater than a second discharge amount from each of the discharge port groups of the areas other than the outermost areas.

11. The apparatus according to claim 8, wherein the developing solution from the discharge port groups of the outermost areas has a first discharge amount and the developing solution from the discharge port groups of the areas other than the outermost areas has a second discharge amount, and wherein the first discharge amount is greater than the second discharge amount.

12. The apparatus according to claim 8, wherein a first temperature of the developing solution from each of the discharge port groups at the outermost areas is greater than a second temperature of the developing solution from each of the discharge port groups of the areas other than the outermost areas.

13. The apparatus according to claim 8, the central area further comprising one port, the port shaped so that a width thereof narrows with approach, in the longitudinal direction, towards a center thereof.

14. The apparatus according to claim 8, wherein the central area has a plurality of discharge ports, each discharge port in the central area having a size that varies relative to its proximity to a first position of the central area, the first position of the central area corresponding to a center location of the object held by the spin chuck, the size of the discharge port located at the first position of the central area being minimum, the size of the discharge ports increasing in size relative to its proximity from the first position.

15. The apparatus according to claim 8, the valves comprising one of an air-operating valve and a solenoid valve.

16. An apparatus for developing an object having a circular disk shape, the apparatus comprising:

a spin chuck that holds and rotates the object;

a nozzle having a plurality of discharge ports arranged along a longitudinal direction of the nozzle, the nozzle being capable of being positioned at a discharge position located above the object held by the spin chuck, the plurality of discharge ports being divided into a plurality of discharge port groups each including at least one of the discharge ports, the nozzle being divided into a plurality of areas with respect to the longitudinal direction, each of the areas provided with one of the discharge port groups respectively, the areas including a central area facing a central portion of the object and a pair of outermost areas facing peripheral portions of the object diametrically opposed each other respectively when the nozzle is located at the discharge position; and a first controller that controls a discharge timing of a developing solution so that the central area discharge port group starts to discharge the developing solution at a first timing and the outermost area discharge port groups start to discharge the developing solution at a second timing, the first and second timings being different.

17. The apparatus according to claim 16, wherein the second timing is prior to the first timing.

18. The apparatus according to claim 16, further comprising:

a second controller that controls a discharge period of the developing solution so that the central area discharge port group discharges developing solution for a first time period and the discharge port groups of the outermost areas discharge developing solution for a second time period, the first and second time periods being different from each other.

19. The apparatus according to claim 18, wherein the second time period is longer than the first time period.

20. The apparatus according to claim 18, further comprising:

a third controller that controls a discharge amount of the developing solution so that the central area discharge port group discharges a first amount of the developing solution and each of the discharge port groups of the outermost areas discharge a second amount of the developing solution, the first and second amounts of developing solution being different from each other.

21. The apparatus according to claim 20, wherein the second amount of developing solution is greater than the first amount of developing solution.

22. An apparatus for developing an object having a circular disk shape, said apparatus comprising:

a spin chuck that holds and rotates the object;

a nozzle having a plurality of discharge ports arranged along a longitudinal direction of the nozzle, the nozzle being capable of being positioned at a discharge position located above the object held by the spin chuck, the plurality of discharge ports being divided into a plurality of discharge port groups each including at least one of the discharge ports, the nozzle being divided into a plurality of areas with respect to the longitudinal direction, each of the areas provided with one of the discharge port groups respectively, the areas including a central area facing a central portion of the object and a pair of outermost areas facing peripheral portions of the object diametrically opposed each other respectively when the nozzle is located at the discharge position; and a controller that controls a discharge period of the developing solution so that the central area discharge port group discharges developing solution for a first time period and the discharge port groups of the outermost areas discharge developing solution for a second time period, the first and second time periods being different from each other.

23. The apparatus according to claim 22, wherein the second time period is longer than the first time period.

24. An apparatus for developing an object having a circular disk shape, said apparatus comprising:

a spin chuck that holds and rotates the object;

a nozzle having a plurality of discharge ports arranged along a longitudinal direction of the nozzle, the nozzle being capable of being positioned at a discharge position located above the object held by the spin chuck, the plurality of discharge ports being divided into a plurality of discharge port groups each including at least one of the discharge ports, the nozzle being divided into a plurality of areas with respect to the longitudinal direction, each of the areas provided with one of the discharge port groups respectively, the areas including a central area facing a central portion of the object and a pair of outermost areas facing peripheral portions of the object diametrically opposed each other respectively when the nozzle is located at the discharge position; and a controller that controls a discharge amount of a developing solution so that the central area discharge port group discharges a first amount of the developing solution and each of the discharge port groups of the outermost areas discharge a second amount of the developing solution, the first and second amounts being different from each other.

25. The apparatus according to claim 24, wherein the second amount is greater than the first amount.

* * * * *